US005813343A

United States Patent [19]

Harb

[11] Patent Number: 5,813,343

[45] Date of Patent: Sep. 29, 1998

[54] PRINTING MEDIA ROLL MOUNTING AND POSITIONING MECHANISM

[75] Inventor: Douglas L. Harb, Woodland Hills, Calif.

[73] Assignee: Eltron International, Inc., Simi Valley, Calif.

[21] Appl. No.: 734,871

[22] Filed: Oct. 22, 1996

Related U.S. Application Data

[60] Provisional application No. 60/005,813 Oct. 23, 1995.

[51] Int. Cl.[6] ..... B41F 1/28

[52] U.S. Cl. ..... 101/407.1; 101/212; 242/596.1; 242/596.7

[58] Field of Search ..... 101/407.1, 212; 69/1, 2; 160/323.1, 324, 325, 326; 403/368, 369; 492/60; 242/596.1, 596.7

[56] References Cited

U.S. PATENT DOCUMENTS

| | | | |
|---|---|---|---|
| 2,250,025 | 7/1941 | Klein | 242/78 |
| 4,105,168 | 8/1978 | Rutherford | 242/596.1 |
| 4,913,367 | 4/1990 | Hata | 242/596.7 |
| 4,948,064 | 8/1990 | Richard | 242/596.7 |
| 5,025,998 | 6/1991 | Hutzenlaub et al. | 242/596.1 |
| 5,472,153 | 12/1995 | Crowley et al. | 242/596.1 |
| 5,486,259 | 1/1996 | Goodwin et al. | 242/596.1 |

*Primary Examiner*—Edgar S. Burr
*Assistant Examiner*—Anthony H. Nguyen
*Attorney, Agent, or Firm*—Freilich, Hornbaker & Rosen

[57] ABSTRACT

A printing media roll mounting mechanism including a frame defining a roll compartment for accommodating a printing media roll. First and second roll holders are mounted in the compartment in axial alignment substantially perpendicular to the web path for concurrent oppositely directed linear movement. The first and second roll holders are spring urged toward one another but can be moved apart to receive different width media rolls therebetween. When the first roll holder is moved outwardly, e.g., to the right, against the spring urging, the second roll holder will also move outwardly to the left. The two roll holders are spring urged toward each other to respectively engage opposite ends of a media roll core placed therebetween.

8 Claims, 5 Drawing Sheets

PRINTING MEDIA ROLL MOUNTING AND POSITIONING MECHANISM

This application claims the benefit of U.S. Provisional application No. 60/005,813 filed Oct. 23, 1995.

FIELD OF THE INVENTION

This invention relates generally to mechanisms useful in computer driven printers for mounting a printing media roll in a position to supply web material to be printed upon along a path to a printing station.

Computer driven thermal printers are widely used in diverse applications for printing receipts, labels, etc. Such printers typically use a printing media roll comprised of a web of printing media wound on an internal tubular core. The printing media can, for example, comprise plain thermal paper or linerless adhesive backed label paper. It is generally desirable that the printer accommodate a variety of rolls of different widths and that a user be able to readily replace a roll.

SUMMARY OF THE INVENTION

The present invention is directed to a mounting mechanism useful in a computer driven printer for accommodating media rolls of different widths and for automatically positioning each such roll relative to the center line of a defined web path.

Apparatus in accordance with the invention includes a frame defining a roll compartment for accommodating a printing media roll. First and second roll holders are mounted in the compartment in axial alignment substantially perpendicular to the web path for concurrent oppositely directed linear movement. The first and second roll holders are spring urged toward one another but can be moved apart to receive different width media rolls therebetween. In accordance with the invention, when the first roll holder is moved outwardly, e.g., to the right, against the spring urging, the second roll holder will also move outwardly to the left. The two roll holders are spring urged toward each other to respectively engage opposite ends of a media roll core placed therebetween.

In accordance with a preferred embodiment of the invention, the first and second roll holders are respectively mounted on first and second elongate racks, each mounted for reciprocal linear movement parallel to the axis of a media roll accommodated in the roll compartment. The racks are respectively engaged with a common pinion mounted for rotation around a fixed spindle. Rotation of the pinion in a first direction, e.g., clockwise, moves both racks inwardly. Rotation of the pinion in the opposite direction, e.g., counterclockwise, moves the racks outwardly. A spring coupled between at least one of the racks and the frame biases the racks inwardly against the ends of the roll core.

In accordance with the preferred embodiment, each roll holder defines a contact face for engaging one end of the roll core. Each contact face is preferably conically shaped so that it can extend into and support different diameter roll cores.

The novel features of the invention are set forth with particularity in the appended claims. The invention will be best understood from the following description when read in conjunction with the accompanying drawings.

DETAILED DESCRIPTION

Figure 1:
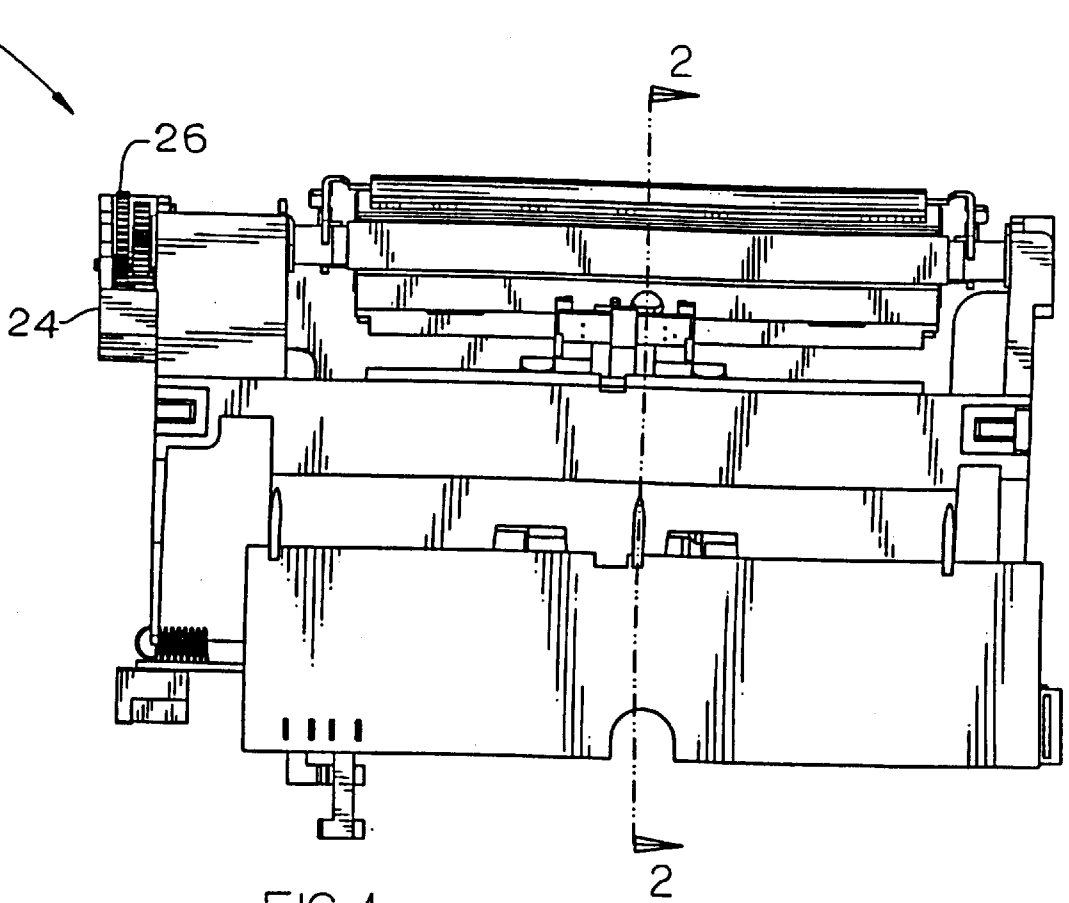
FIG. 1 is a front plan view of a computer driven printer incorporating a media roll mounting mechanism in accordance with the present invention.
Figure 2:
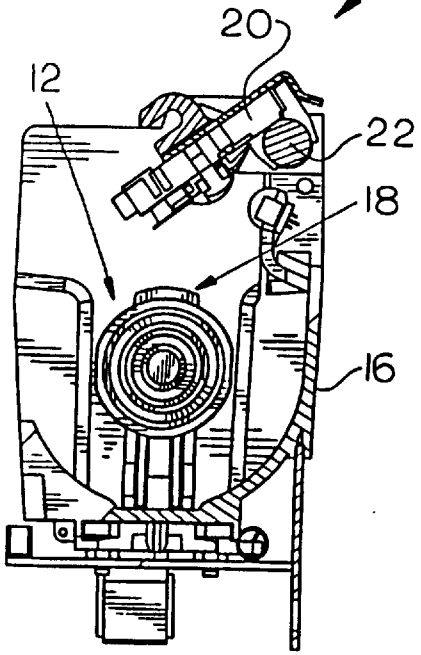
FIG. 2 is a sectional view taken substantially along the plane 2—2 of FIG. 1.

Attention is now directed to FIGS. 1 and 2 which depict a computer driven printer 10 in accordance with the invention incorporating a mechanism 12 for mounting and positioning a printing media roll (not shown). More particularly, the printer 10 is comprised of a frame 16 defining an internal roll compartment 18 for accommodating a variety of differently dimensioned standard printing media rolls. Such rolls are typically comprised of a web of printing media, e.g., plain thermal paper or linerless adhesive back thermal paper. These are commercially available in different widths and lengths and typically have internal tubular cores which may have different inner diameters. Apparatus in accordance with the present invention is intended for accommodating a variety of differently dimensioned rolls.

The printer 10 is depicted as including a print head 20 mounted opposite to a drive roller/platen 22. Printing media is fed from a roll (not shown) in the compartment 18 along a path extending between print head 20 and platen 22 which together define a printing station. The drive roller/platen 22 is driven by a motor 24 via gearing 26.

Figure 3:
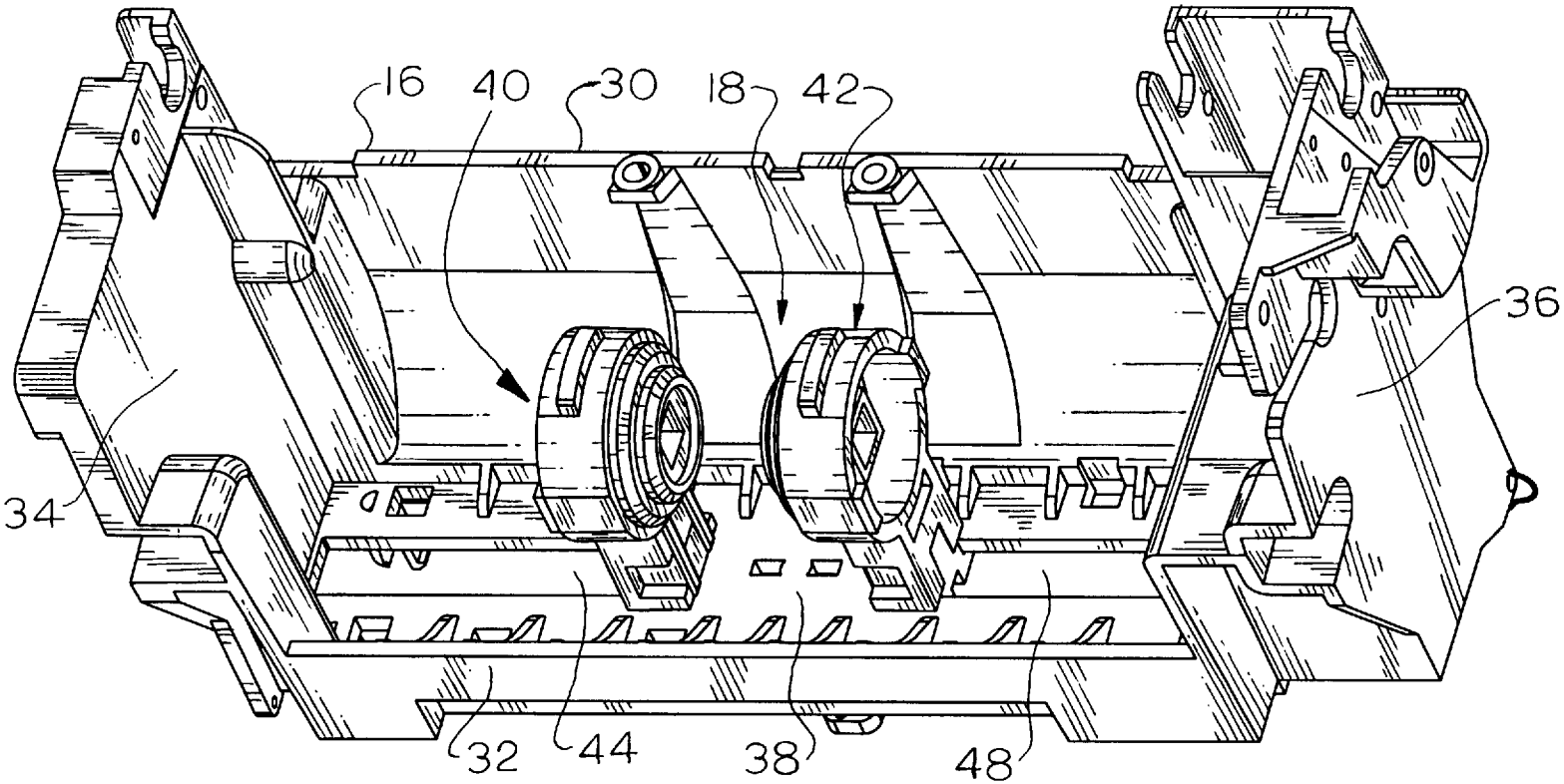
FIG. 3 is a top isometric view of the frame of FIG. 1 showing a roll mounting mechanism in accordance with the invention including a roll compartment and first and second roll holders mounted therein for concurrent oppositely directed axial movement.

Attention is now directed to FIG. 3 which better illustrates the roll mounting and positioning mechanism in accordance with the present invention. FIG. 3 shows frame 16 which includes roll compartment 18 defined essentially between front wall 30, rear wall 32, first and second end walls 34, 36 and floor 38. First and second roll holders 40, 42 are mounted in the compartment 18 for reciprocal linear movement along paths respectively defined by elongate slots 44, 48 defined in floor 38.

Figure 5:
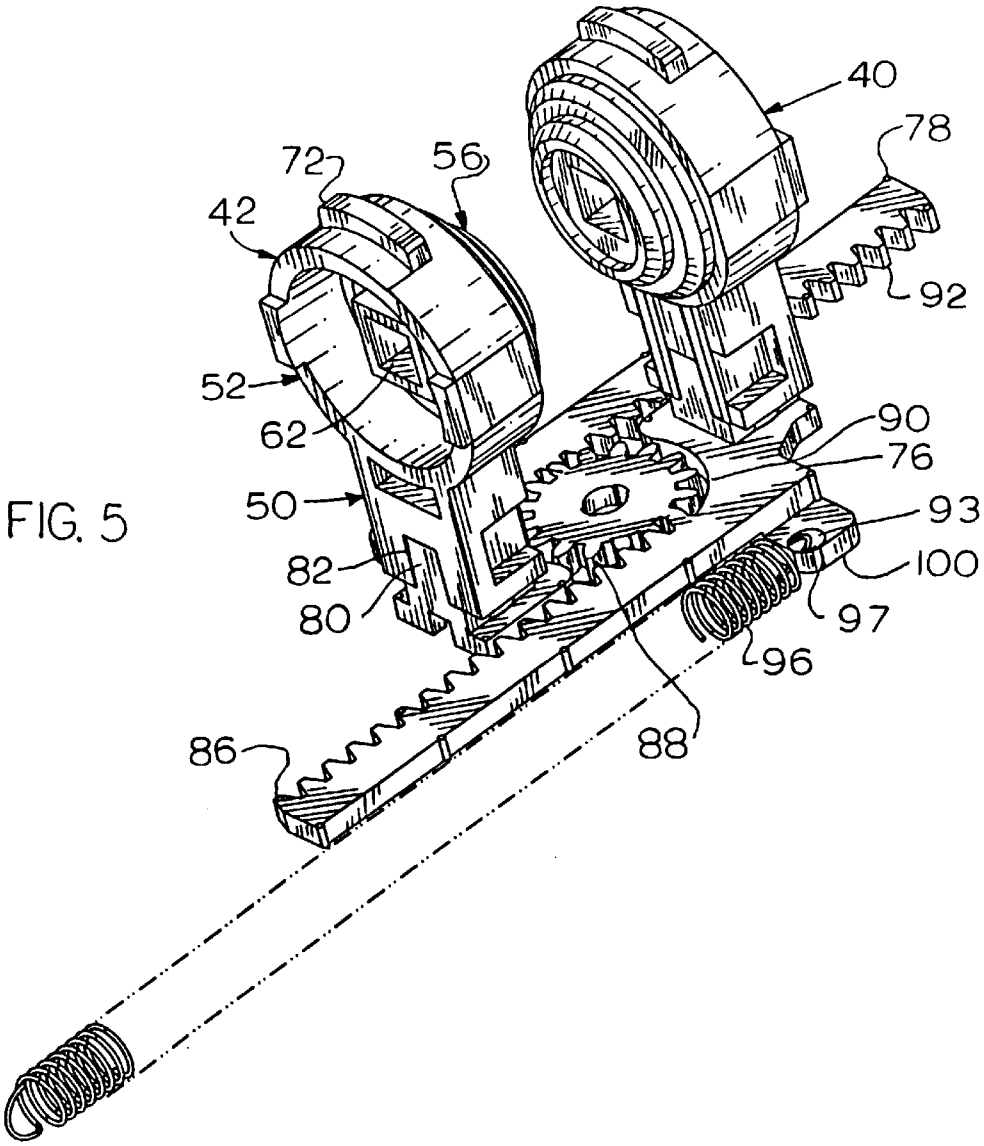
FIG. 5 is an enlarged isometric view showing the roll holders and racks in greater detail along with the common pinion and spring for biasing the roll holders toward each other.
Figure 6:
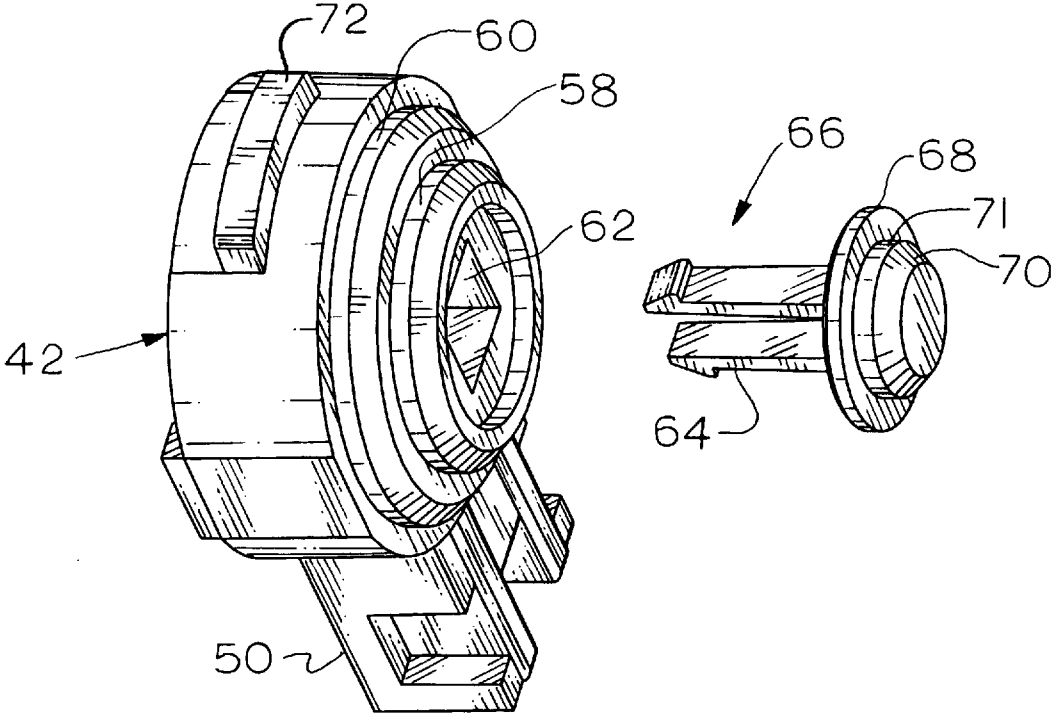
FIG. 6 is an isometric view showing the use of an optional insert into the roll holder conical face for accommodating smaller printing medial rolls.

As can best be seen in FIG. 5, each roll holder is essentially comprised of a post portion 50 and a cylindrical head portion 52. The cylindrical portion 52 defines an essentially conically shaped roll contact face 56 formed by stepped axially spaced concentric portions 58, 60, etc. (FIG. 6) configured to accommodate the inner diameters of differently dimensioned tubular cores. The cylindrical head 52 further defines an axially oriented rectangular bore 62 dimensioned to accommodate spaced spring legs 64 of an insert 66 (FIG. 6). The insert 66 includes a flange 68 and a forwardly projecting tapered button 70. When the legs 64 of insert 66 are accommodated in the rectangular bore 62, the flange 68 and button 70 cooperate with the aforementioned concentric step portions 58, 60 to extend the truncated conical form defined by steps 58 and 60 by an additional step portion 71.

Each of the roll holders preferably also includes a finger tab 72 extending radially from the cylindrical head 52 in a direction opposite to post 50. Roll holders 40 and 42 are respectively mounted on the ends of elongate racks 76, 78 extending through floor slots 44, 48. Note in FIG. 5 that each rack includes a mounting stud 80 which extends into a pocket 82 formed in the roll holder post 50 for orienting and retaining the roll holder.

Figure 4:
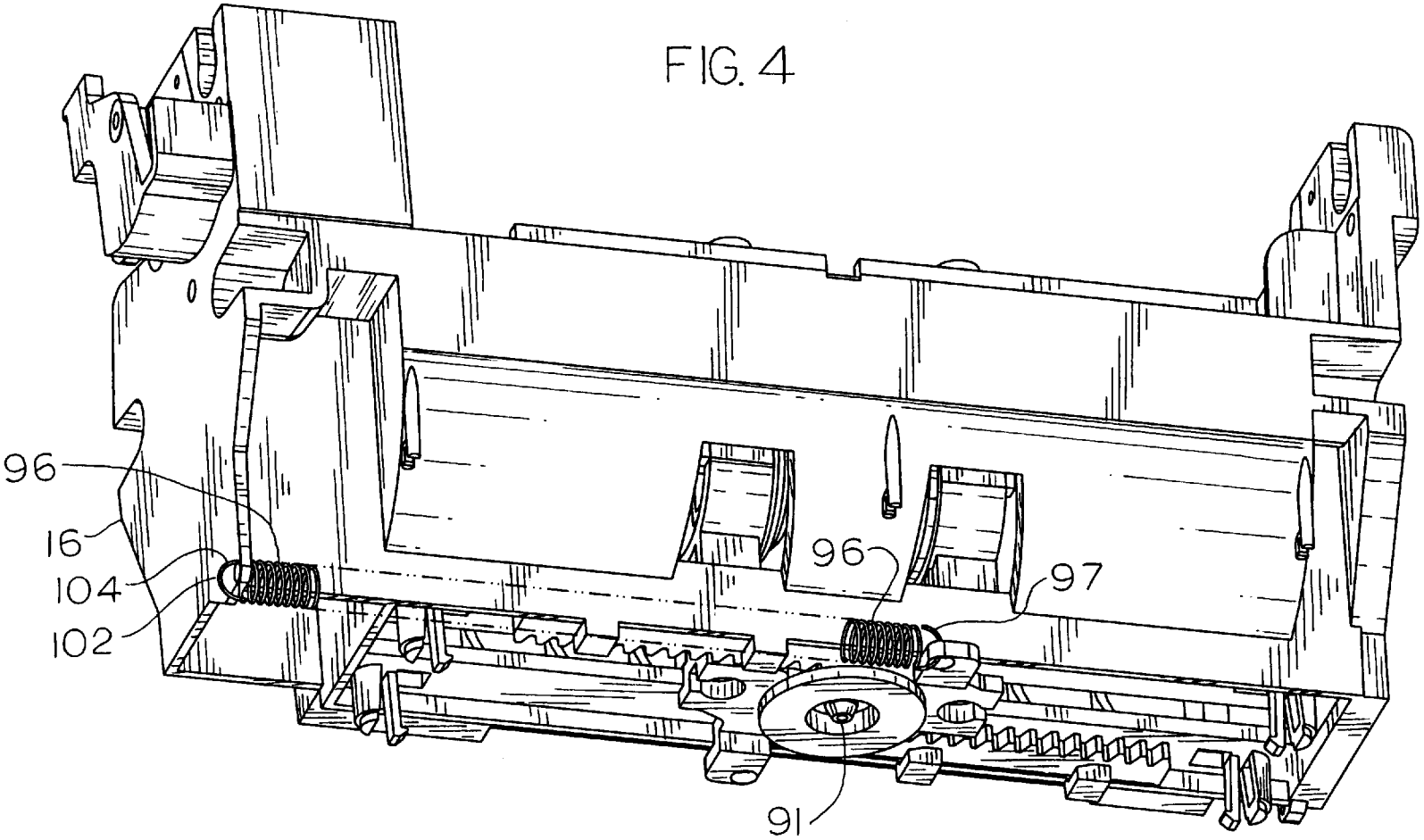
FIG. 4 is a bottom isometric view of the frame of FIG. 3 showing the first and second elongate racks which support the aforementioned first and second roll holders.

The elongate rack 76 defines a series of teeth 86 which engage with teeth 88 circumferentially formed on pinion 90 mounted for rotation on spindle 91 (FIG. 4). Similarly, rack 78 defines a series of teeth 92 which engage the pinion teeth 88 at a location essentially diametrically displaced from rack 76. Racks 76 and 78 are mounted for parallel reciprocal linear movement in opposite directions. That is, when rack 76 of FIG. 5 moves to the left, i.e., roll holder 40 moves inwardly, it will turn pinion 90 in a clockwise direction which in turn moves rack 78 to the right, thus also moving roll holder 42 inwardly, that is toward roll holder 40.

On the other hand, when an axial force is exerted on one of the roll holders to move it outwardly, the other roll holder will correspondingly move outwardly. Thus, when rack 76 of FIG. 5 moves to the right, pinion 90 will turn counter clockwise to move rack 78 to the left, thus moving roll holders 40 and 42 apart.

In accordance with the present invention, a spring 96 is provided to bias the roll holders 40 and 42 toward one another to the position depicted in FIG. 5. More particularly, note that one end 97 of coil spring 96 is looped through hole 98 in tab 100 extending outwardly from rack 86. The other end 102 of spring 96 is looped through hole 104 in frame 16 (FIG. 4). Thus, spring 96 is biased to pull rack 76 to close the gap between roll holders 40 and 42. When a user desires to place a printing media roll between the contact faces 56 of the roll holders, he need merely push one of the roll holders axially. Because of their coupling through common pinion 90, the roll holders will concurrently linearly move away from the center of pinion 90. Thus, the media roll will always be positioned centrally with respect to the axis of pinion 90 regardless of the width of the media roll being used.

From the foregoing, it should be recognized that a mechanism has been disclosed herein for easily mounting media rolls of different sizes within a roll compartment of a computer driven printer. A wide range of roll sizes can be accommodated and each roll will be centered with respect to the axis of pinion 90 in the disclosed embodiment. The spring bias acting on racks 76 and 78 urges the contact faces 56 of roll holders 40 and 42 toward each other to accommodate the narrowest rolls when inserts 66 are used. However, by pushing one of the roll holders outwardly, the roll holders will move away from each other to enable them to accommodate increasingly larger width rolls therebetween. The conical faces of the roll holders are configured to extend into the ends of the roll core with the core being able to rotate on the steps 58, 60. Inserts 66 can be removed to maximize the spacing between contact faces 66.

Although one specific embodiment of the invention has been described, it is recognized that variations and modifications within the spirit and scope of the invention will readily occur to those skilled in the art. For example only, the spring can be configured in various ways to bias the roll holders toward one another.

I claim:

1. Apparatus for mounting a tubular core carrying a roll of web material of any width within a predefined range for feeding said web material from said roll along a web path having a defined centerline, said apparatus comprising:

a first roll holder having a contact face for engaging a first end of a tubular core;

a second roll holder having a contact face positioned opposite to said first contact face for engaging a second end of a tubular core;

reciprocal movement apparatus coupled to said first and second roll holders for causing each of said contact faces to linearly move away from said centerline in response to movement of the other of said contact faces away from said centerline for enabling a tuabular core of any width within said predefined range to be inserted between said contact faces to position said core symmetrically with respect to said centering; and spring means for urging said roll holders toward said centerline for automatically engaging said roll holder contact faces against a tubular core inserted therebetween without requiring additional user intervention.

2. The apparatus of claim 1 wherein said reciprocal movement apparatus comprises:

first and second elongate racks respectively supporting said first and second roll holders, each of said racks having an inner surface defining a series of teeth; and a pinion mounted for rotation between said first and second roll holders; said pinion having circumferentially formed pinion teeth to engage said teeth of said first and second racks.

3. The apparatus of claim 1 wherein said contact faces each define first and second concentric ridges for engaging differently sized tubular cores.

4. The apparatus of claim 3 additionally comprising first and second extension inserts respectively coupled to said first and second contact faces for defining third ridges concentric with said first and second ridges.

5. Apparatus for mounting a roll of web material carried on a tubular core of any width within a predefined range, symmetrically with respect to a web path centerline extending perpendicular to said tubular core, said apparatus comprising:

a first roll holder having a contact face configured to engage a tubular core first end;

a second roll holder having a contact face configured to engage a tubular core second end;

a mounting structure supporting said first and second roll holder contact faces in alignment opposite to one another, said mounting structure permitting reciprocal continuous linear movement of each of said contact faces toward, and away from, said centerline;

a coupling mechanism interconnecting said first and second roll holders for causing equidistant movement of said roll holders in unison either toward, or away from, said centerline for enabling a tubular core of any width within said predefined range to be inserted between said contact faced to position said core symmetrically with respect to said centerline; and a spring mechanism acting on at least one of said roll holders for urging said first and second roll holder contact faces toward said centerline for automatically engaging said contact faces against the ends of the tubular core therebetween without requiring additional user intervention.

6. The apparatus of claim 5 wherein said coupling mechanism comprises:

first and second elongate racks, each of said racks having an inner surface defining a series of teeth; and a pinion mounted for rotation between said first and second roll holders; said pinion having circumferentially formed pinion teeth to engage said teeth of said first and second racks.

7. The apparatus of claim 5 wherein said contact faces each define first and second concentric ridges for engaging differently sized tubular cores.

8. The apparatus of claim 7 additionally comprising first and second extension inserts respectively coupled to said first and second contact faces for defining third ridges concentric with said first and second ridges.

* * * * *